US008776750B2

(12) United States Patent
Christgen et al.

(10) Patent No.: US 8,776,750 B2
(45) Date of Patent: Jul. 15, 2014

(54) ASSEMBLY FOR A VALVE TRAIN OF AN INTERNAL COMBUSTION ENGINE

(75) Inventors: Wolfgang Christgen, Seukendorf (DE); Frank Himsel, Obermichelbach (DE); Junichi Ichikawa, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 155 days.

(21) Appl. No.: 13/394,851

(22) PCT Filed: Jul. 29, 2010

(86) PCT No.: PCT/EP2010/061011

§ 371 (c)(1),
(2), (4) Date: Mar. 8, 2012

(87) PCT Pub. No.: WO2011/029666

PCT Pub. Date: Mar. 17, 2011

(65) Prior Publication Data

US 2012/0167850 A1 Jul. 5, 2012

(30) Foreign Application Priority Data

Sep. 8, 2009 (DE) ..... 10 2009 040 607

(51) Int. Cl.
*F01L 1/30* (2006.01)

(52) U.S. Cl.
USPC ..... 123/90.46; 123/90.42; 123/90.59

(58) Field of Classification Search
USPC ..... 123/90.42, 90.43, 90.45, 90.46, 90.5, 123/90.55–90.59
See application file for complete search history.

(56) References Cited

U.S. PATENT DOCUMENTS 5,894,822 A * 4/1999 Speil ..... 123/90.43
6,314,927 B1 * 11/2001 Schnell ..... 123/90.16

(Continued)

FOREIGN PATENT DOCUMENTS

DE 23 50 520 A1 4/1975
DE 10 2005 010 750 A1 9/2006
WO WO 2009072481 A1 * 6/2009

OTHER PUBLICATIONS

American Heritage Dictionary, 2000.*

*Primary Examiner* — Thomas Denion
*Assistant Examiner* — Steven D Shipe
(74) *Attorney, Agent, or Firm* — Davidson, Davidson & Kappel, LLC

(57) ABSTRACT

An assembly for a valve train of an internal combustion engine, which has a hydraulic support element and a cam follower resting on one end via a bearing surface located on the bottom side thereof on a complimentary end side of a pressure piston of the support element. The piston extends across the outer shell in a bore of a crucible-shaped housing of the support element. The housing has an opening for hydraulic fluid, which is conductible via a channel between the housing and piston through a passage in the pressure piston to a storage chamber. In a section of a direct contact region between the bearing surface of the cam follower and end side of the piston, an anti-turn mechanism for the piston in relation to the cam follower is implemented. The piston is installed in a defined manner and is torsionally oriented in relation to the cam follower.

11 Claims, 3 Drawing Sheets

(56) References Cited

U.S. PATENT DOCUMENTS

| | | | | |
|---|---|---|---|---|
| 7,159,551 | B2 * | 1/2007 | Cecur et al. | 123/90.45 |
| 7,261,075 | B2 * | 8/2007 | Hofmann | 123/90.48 |
| 2005/0103300 | A1 * | 5/2005 | Spath et al. | 123/90.59 |
| 2007/0209623 | A1 * | 9/2007 | Klotz | 123/90.48 |
| 2009/0031977 | A1 * | 2/2009 | Bugescu et al. | 123/90.55 |
| 2009/0145388 | A1 * | 6/2009 | Hiramatsu | 123/90.39 |
| 2012/0042843 | A1 * | 2/2012 | Kubota et al. | 123/90.55 |

* cited by examiner

ASSEMBLY FOR A VALVE TRAIN OF AN INTERNAL COMBUSTION ENGINE

CROSS-REFERENCE TO RELATED APPLICATION

This application is a 371 of PCT/EP2010/061011 files Jul. 29, 2010, which in turn claims the priority of DE 10 2009 040 6073 filed Sep. 8, 2009. The priority of both applications is hereby claimed and both applications are incorporated by reference herein.

FIELD OF THE INVENTION

The invention relates to an assembly for a valve train of an internal combustion engine.

BACKGROUND OF THE INVENTION

The prior art is an assembly, in the supporting element of which the pressure piston is seated in the housing such that it can move freely rotationally. A passage of the pressure piston for hydraulic medium therefore lies at any desired rotational position with respect to the housing during operation and ultimately also longitudinally in the region of tensile or compressive stresses which are introduced via the head of the pressure piston in the case of earn loading of the resting drag lever. In the section of the corresponding passage, the introduced forces can lead to stress peaks which destroy components. In order to counteract the former, the elements optionally have to have thicker dimensions or the maximum rotational speed to be used is to be reduced.

Moreover, in the case of an installation of the assembly in a cylinder head with a receptacle for the supporting element, which receptacle extends obliquely with respect to the perpendicular, it occurs that, in the unfavorable case in the latter (passage "lying at the bottom"), the storage space of said supporting element is undesirably emptied of hydraulic medium, with the result that air may be sucked into a high pressure space of the hydraulic play compensation apparatus,

SUMMARY OF THE INVENTION

Broadly, the present invention relates to an assembly for a valve train of an internal combustion engine, which has a hydraulic supporting element and a drag lever that is seated at one end, via a bearing face which is situated in its underside, on a complementary end face of a pressure piston of the supporting element. The pressure piston runs via its outer shell in a bore of a cup-shaped housing of the supporting element. The housing has a duct for hydraulic medium which can be guided via a channel between the housing and the pressure piston to at least one passage in the pressure piston to a storage space in the latter.

According to the invention, in the section of a direct contact region between the bearing face of the drag lever and the end face of the pressure piston, an anti-rotation safeguard is produced for the pressure piston with respect to the drag lever, and the pressure piston is installed in a manner which is rotationally oriented in a defined way with respect to the drag lever.

A component is therefore present, in which the disadvantages which are cited in the introduction are no longer to be expected. The duct in the pressure piston is "compulsorily" positioned outside a region of stress peaks during operation, is therefore positioned laterally and lies in the region of a fiber which is free of stress, as it were. A destruction of components as a result of undesirable stress peaks in the duct region is no longer to be expected. The anti-rotation safeguard is produced merely by an artful design of the contact region between the drag lever and a head of the pressure piston of the supporting element. Further components can be dispensed with.

It is expedient to hold the housing such that it is rotationally movable with respect to the pressure piston and to produce an annular groove for a hydraulic medium tap on its outer shell. The housing can also optionally be present in a form which is secured against rotation with respect to the pressure piston. Should the annular groove be dispensed with, the receiving hole in the cylinder head optionally has to have an annular groove or an aligned installation has to take place.

It is proposed to configure said contact region with a geometry which differs from a hemisphere (gothic profiles, etc, included) and has up to now been realized in the prior art. The degree of freedom in the joint region is therefore reduced by 1, in order to prevent a rotational movement about its longitudinal axis under the drag lever of the pressure piston which is mounted in an oriented manner.

Examples for geometries in the contact region are, as proposed, cylinder or barrel sections which are simple to manufacture (also sections which are similar to cylinders or barrels) or cylinder sections with end-side, quadrant and cap-like projections.

The invention is valid even in the case of an oblique installation of the supporting element into a respective guide hole of the cylinder head. Here, the passage in the pressure piston can be positioned at a geodetically high point via the anti-rotation safeguard in the contact region.

In order to counteract undesirable wear in the contact region, a wear protection layer can be applied separately to at least one of the contact partners. A special thermal treatment can optionally also be considered.

During mounting of the assembly, ultimately merely the pressure piston of the supporting element has to be mounted in an "aligned" manner with respect to the drag lever.

Simple measures for guiding the hydraulic medium to the storage space in the pressure piston are the subject matter of a further subclaim. According to said subclaim, starting from at least one duct in the housing, an annular groove tap in the region of an interface between the pressure piston and the housing is preferably considered. The at least one duct and the at least one passage are preferably produced as bores, windows or the like also being considered.

DETAILED DESCRIPTION OF THE DRAWING

Figure 1:
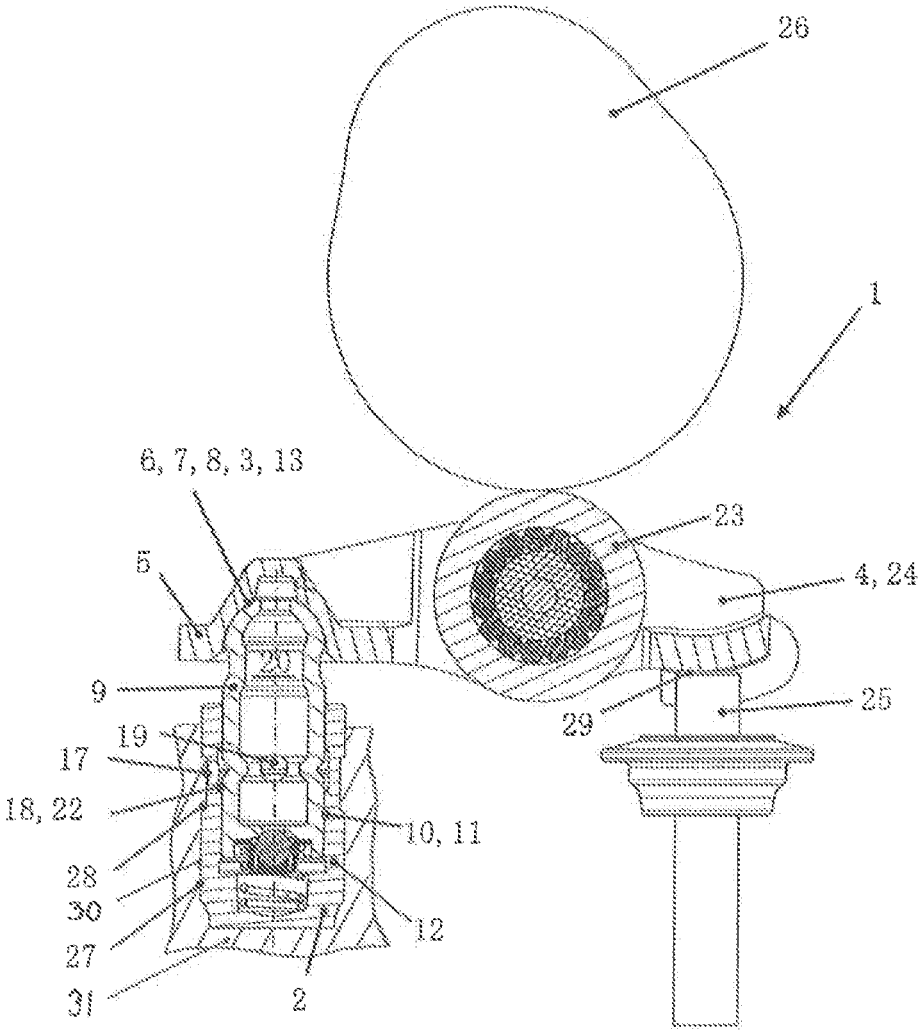
FIG. 1 shows a longitudinal section through the assembly.

An assembly 1 is shown for a valve train of an internal combustion engine. Said assembly 1 is formed from a hydraulic supporting element 2 and a drag lever 4. The former is disposed in a guide hole 30 in a cylinder head 31 (shown schematically in FIG. 1) of the internal combustion engine and the latter is seated at one end 5, via a bearing face 6 which is situated in its underside 7, on a complementary end face 8 of a pressure piston 9 of the supporting element 2. The pressure piston 9 runs via its outer shell 10 in a bore 11 of a cup-shaped housing 12 of the supporting element 2. At the other end 24, the drag lever 4 has a rest 29 for a valve stem 25 on the underside 7. The drag lever 4 has a cam roller 23 in the region of a center. Said cam roller 23 is in contact with a cam 26 when installed.

The housing 12 has a duct 17 (bore) for hydraulic medium which can be guided via a channel 18 (annular groove tap) between the housing 12 and the pressure piston 9 to the passage 19 (bore) in the pressure piston 9 and from there to a storage space 20 in said pressure piston 9.

A direct contact region 3 between the bearing face 6 under the drag lever 4 and the end face 8 (head) of the pressure piston 9 of the supporting element 2 acts as anti-rotation safeguard 13 for the pressure piston 9 with respect to the drag lever 4. The degree of freedom in the joint region is therefore reduced.

As disclosed in the drawing (FIG. 1), the passage 19 for the hydraulic medium is "compulsorily" rotated out of the loading one described in the introduction and, in simple terms, is seated laterally in the neutral region of the pressure piston 9, which region is free of stress, as it were. A risk of fracture after long term loading during operation is eliminated. Components, which are configured with thinner walls than previously, can optionally be used.

Figure 2:
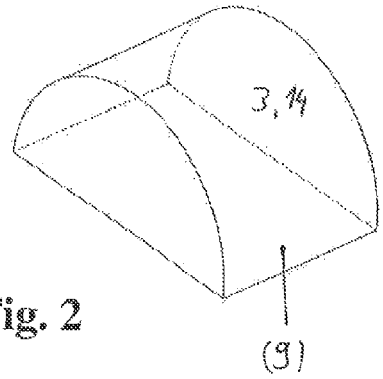
FIGS. 2, 4, 6, 8 disclose special designs of an end face of the pressure piston, and embodiments which are complementary to this of a bearing face on the drag lever are apparent from FIGS. 3, 5, 7, 9.
Figure 3:
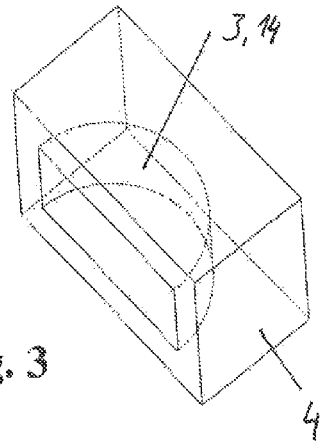

According to FIGS. 2, 3, the contact region 3 can describe a shape of a cylinder section 14.

Figure 4:
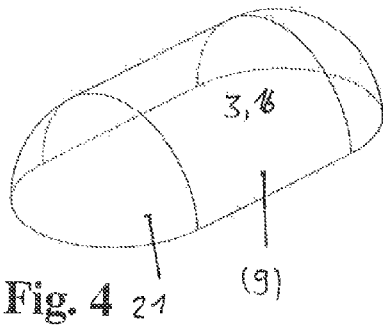
Figure 5:
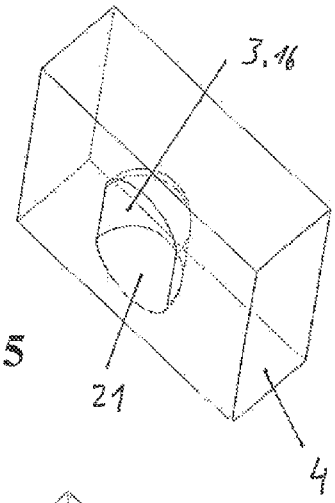

According to FIGS. 4, 5, the contact region 3 is configured as a cylinder section 16 with double-sided quadrant sections 21.

Figure 6:
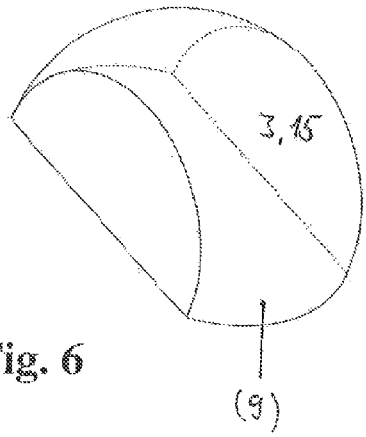
Figure 7:
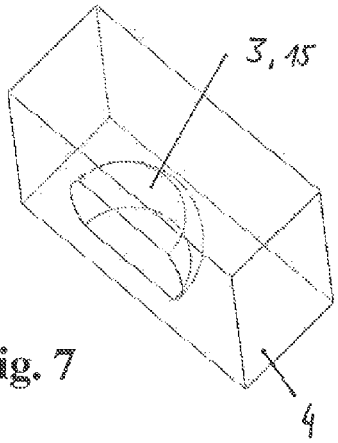

FIGS. 6, 7 disclose a design of the contact region 3 as barrel section 15.

Figure 8:
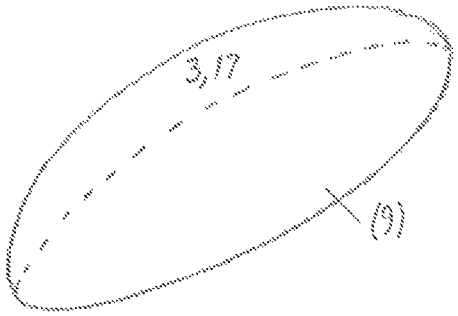
Figure 9:
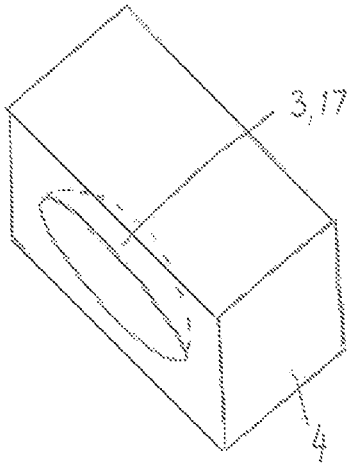

FIGS. 8, 9 disclose a design of the contact region 3 as an ellipsoid section 17. It is clear that a multiplicity of further geometries are conceivable for producing the anti-rotation safeguard 13 at the contact region 3, for example geometries which are similar to ellipsoids.

LIST OF DESIGNATIONS

1) Assembly
2) Supporting Element
3) Contact Region
4) Drag Lever
5) One End
6) Bearing Face
7) Underside
8) End Face
9) Pressure Piston
10) Outer Shell
11) Bore
12) Housing
13) Anti-rotation Safeguard
14) Cylinder Section
15) Barrel Section
16) Cylinder Section
17) Duct
18) Channel
19) Passage
20) Storage Space
21) Quadrant Section
22) Annular Groove
23) Cam Roller
24) Other End
25) Valve Stem
26) Cam
27) Outer Shell
28) Annular Groove
29) Rest

The invention claimed is:

1. An assembly for a valve train of an internal combustion engine, comprising:

a hydraulic supporting element having a cup-shaped housing and a pressure piston, the cup-shaped housing has a bore and a duct for a hydraulic medium, the pressure piston has an outer shell with an end face, at least one passage and a storage space, the pressure piston runs via the outer shell in the bore of the cup-shaped housing, and the hydraulic medium can be guided via a channel between the housing and the pressure piston to the at least one passage in the pressure piston to the storage space in the pressure piston; and a drag lever, which is seated at one end, via a bearing face that is situated in an underside of the drag lever, on the end face of the pressure piston that is complementary to the bearing face of the drag lever, wherein the bearing face of the drag lever contacts the end face of the pressure piston with a direct contact region, and the pressure piston is installed in a manner which is rotationally oriented in a defined way with respect to the drag lever, the direct contact region being configured to provide and anti-rotation safeguard so that the pressure piston remains rotationally oriented in the defined way with respect to the drag lever wherein the housing is rotationally movable with respect to the pressure piston.

2. The assembly as claimed in claim 1, wherein the housing has an outer shell and the outer shell has an annular groove at a level of the duct.

3. The assembly as claimed in claim 1, wherein the contact region is shaped to diverge from a hemispherical section or a spherical section.

4. The assembly as claimed in claim 1, wherein the contact region is a cylindrical section.

5. The assembly as claimed in claim 1, wherein the contact region is a barrel-shaped section.

6. The assembly as claimed in claim 1, wherein the contact region describes a shape of a cylinder section with single-sided or double-sided rounded ends.

7. The assembly as claimed in claim 1, wherein the contact region is an ellipsoid.

8. The assembly as claimed in claim 1, wherein the pressure piston is held in the housing so that the passage runs transversely with respect to a longitudinal direction of the drag lever.

9. The assembly as claimed in claim 1, further comprising a cylinder head of the internal combustion engine, the cylinder head having a guide hole for the supporting element, which guide hole runs obliquely with respect to a vertical direction, wherein the pressure piston is held in the housing so that the passage is at a geodetically high point in a circumference of the piston during installation of the supporting element in the guide hole.

10. The assembly as claimed in claim 1, wherein the channel between the housing and the pressure piston consists of an annular groove in the bore of the housing, the annular groove being intersected by the duct in the housing and fluid-connected directly to the passage in the outer shell of the pressure piston.

11. The assembly as claimed in claim 1, wherein the contact region has a separate wear protection layer.

* * * * *